US007159595B2

(12) United States Patent
Cho

(10) Patent No.: US 7,159,595 B2
(45) Date of Patent: Jan. 9, 2007

(54) PAD FOR NAIL CARE DEVICES

(76) Inventor: Yong Hoon Cho, 604 Murfield Ct., Fullerton, CA (US) 92835

( * ) Notice: Subject to any disclaimer, the term of this patent is extended or adjusted under 35 U.S.C. 154(b) by 434 days.

(21) Appl. No.: 10/407,878

(22) Filed: Apr. 4, 2003

(65) Prior Publication Data

US 2004/0194795 A1 Oct. 7, 2004

(51) Int. Cl.
*A45D 29/18* (2006.01)

(52) U.S. Cl. ..... 132/73.5; 132/75.5

(58) Field of Classification Search ..... 132/73, 132/75, 76.4, 75.3–75.6; 30/26, 28; 294/99.2; 451/524; 16/421, 430
See application file for complete search history.

(56) References Cited

U.S. PATENT DOCUMENTS 3,180,025 A * 4/1965 Tsunemi ..... 30/28
3,855,698 A * 12/1974 Crosby ..... 30/124
4,176,449 A * 12/1979 Lee et al. ..... 30/28
5,031,765 A * 7/1991 Chen ..... 206/234
5,052,416 A * 10/1991 Rommerdale ..... 132/75.5
5,226,849 A * 7/1993 Johnson ..... 30/28
5,490,327 A * 2/1996 Ohori ..... 30/28
5,524,344 A * 6/1996 Bazal ..... 30/28

* cited by examiner

*Primary Examiner*—Todd E. Manahan
(74) *Attorney, Agent, or Firm*—Maria Erlinda Co Sarno

(57) ABSTRACT

A padded receiving device for nail care devices comprising a pad, a pad holder with a pad, or a padded base engaging case, individually or in any combination with each other. The pad holder for supporting the pad has a front slit and an optional rear slit. The pad holder has a top member and a bottom member molded or attached together. A hook from a rear end of the bottom member attaches the pad holder to the nail care device. The pad has a top piece and a bottom piece joined together by a center piece. The center piece situates at an opening bored on the nail care device. The padded receiving device may consist of the pad independent of the pad holder. If the nail care device has a base, the padded receiving device further comprise a padded base engaging case.

20 Claims, 5 Drawing Sheets

PAD FOR NAIL CARE DEVICES

BACKGROUND

This invention relates to a pad for nail care devices. The pad may consist of one part or a combination of parts. Specifically, it may consist of a pad, a pad holder with a pad, or a padded base engaging case, individually or in any combination of these, depending upon the structure of the nail care device. These are hereinafter collectively referred to as a padded receiving device. A nail clipper and a nail file are used to illustrate the padded receiving device. These padded receiving devices provide comfort and enhance control in handling the nail care devices.

Present nail care devices are mostly made of metal which when used constantly could be uncomfortable. These also promote the growth of corn and callouses on the areas repeatedly pressed by the device. Further, metal surfaces can be slippery which can cause accidental clipping of unintended areas of the nails or fingers when the user loses control of the device. Sweat, moisture, lotion and moisturizers on the fingers aggravate the situation. The claimed padded devices using the pads of this invention are meant to aid manicurists, nail care providers and others who constantly use the device.

U.S. Pat. No. 5,052,416 discloses a control improving component for fingernail clippers. These fingernail clippers as disclosed are constructed for use and access by individuals with reduced or impaired manual dexterity. These grip control improving devices are mountable to existing nail clippers. Because it is designed for the challenged individuals, these improving devices are enlarged to ensure easy accessibility, operation and incorporate safeguards that prevent the fingers from easily slipping out of the nail clipper. The safeguards are thumb/finger abutments that slope sizably like a bump in the road in front of the fingers. Since these abutments press on the fingers, they pose the same problem of promoting the formation of corns and callouses after repeated and prolong usage.

The nail clipper collectively refers to fingernail and toenail clippers. The padded receiving areas for the fingers are usually located near the distal end of the nail clipper where the finger or fingers are placed. The distal end is the end opposite the cutting members of the nail clipper. The claimed padded receiving device for the nail clipper consists of at least two parts and are installed in the lever arm and the base of the nail clipper to provide a soft surface to grip on for each finger involved with the operation of the nail clipper both when the nail clipper is in use and not in use.

It is an object of this invention to provide a padded finger receiving area on nail care devices to prevent the formation of corns and callouses on the fingers even after repeated and prolong use.

It is also an object of this invention to provide a pad for nail care devices that do not materially affect the overall size and shape of the device.

It is a further object of this invention to show how the pads are installed in the nail care devices.

BRIEF DESCRIPTION OF THE DRAWING

FIG. 4A' is a back plan view of a pad holder slipped into the lever arm.

SUMMARY OF THE INVENTION

Figure 1:
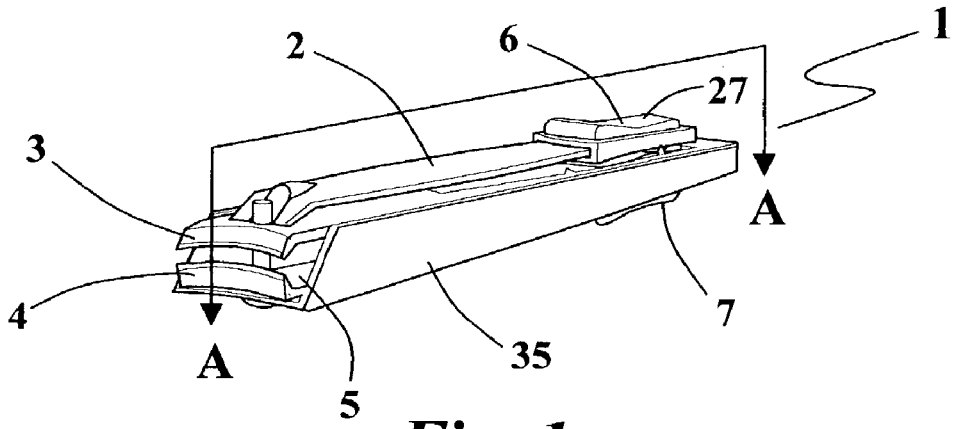
FIG. 1 is a perspective view of the nail clipper with the lever arm in a close position.

The invention is on a padded receiving device for nail care devices. The padded receiving device may comprise of one part or more than one part according to the choice of the manufacturer. One padded receiving device comprises a pad holder for supporting a pad which is preferably soft and resilient. The pad holder has a front slit wherein a nail care device is slipped through, the front slit having a width and height matching the width and height of the nail care device at the location where the pad holder is desired which is the place where the nail care device stops advancing after insertion. The pad holder has a top member having a first opening and a bottom member having a second opening, the top and bottom member molded in one piece or attached together. There is a hook with a head protruding laterally inward from a rear end of the bottom member towards the second opening which is used to attach the pad holder to the nail care device and to keep the bottom piece of the pad on the bottom member when the top piece of the pad is squeezed through the opening bored on the nail care device when the padded finger receiving device is installed. The pad for the pad holder has a top piece and a bottom piece which are joined together resulting into a single piece by a center piece, the center piece matching and covering the opening bored on the nail care device through which the pad is introduced into as stated above. The height of the center piece match the height of the front slit, the top piece has a size matching and covering the first opening of the top member of the pad holder, while the bottom piece has a size matching and covering the second opening of the bottom member of the pad holder. The bottom piece has a cut etched out on a rear end to accommodate the head of the hook extending from the bottom member of the pad holder to keep the bottom piece of the pad on the bottom member during the installation of the padded receiving device on nail care devices.

The padded receiving device may solely consist of the pad independent of the pad holder. In this case, the bottom piece does not need a cut etched out. In both devices described, the pad preferably and in some cases must protrude from either external surfaces of the pad holder or the surfaces the nail care device if a pad holder is not used.

The top and bottom faces or either one of the faces of the pad holder may be flat or curved. The external surfaces of the top and bottom pieces of the pad or either one of them may be additionally carved to ergonomically accommodate a finger.

If the nail care device has a base such as in a nail clipper, the padded receiving device further comprises a padded base engaging case. The padded base engaging case has a case having an opening bored at a location where a pad covering and protruding from the opening of the base engaging case is desired. The base engaging case is made of resilient material to snugly enclose the base of the nail care device, leaving open, sides needed for the operation of a functioning part of the nail care device. The pad used for the base engaging case or simply referred to as case, has a top end and a bottom end, the bottom end having a lip extending laterally from the bottom end to prevent the pad from falling off the opening of the base engaging case. The make up of this pad is similar to the pad used with the pad holder described above. Additional structures such a flange or flanges inwardly extending from the interior surface of the case and made to rest on top of the base or a component of the base reinforce the engagement of the base with the base engaging case.

These padded receiving devices are easily installed into the nail care devices. The description on the manner it is installed and used with nail clippers and nail files provides teaching on how these padded devices can be installed in other nail care devices not shown such as tweezers, cuticle removers, brushes, etc.

DETAILED DESCRIPTION OF THE INVENTION

Figure 2:
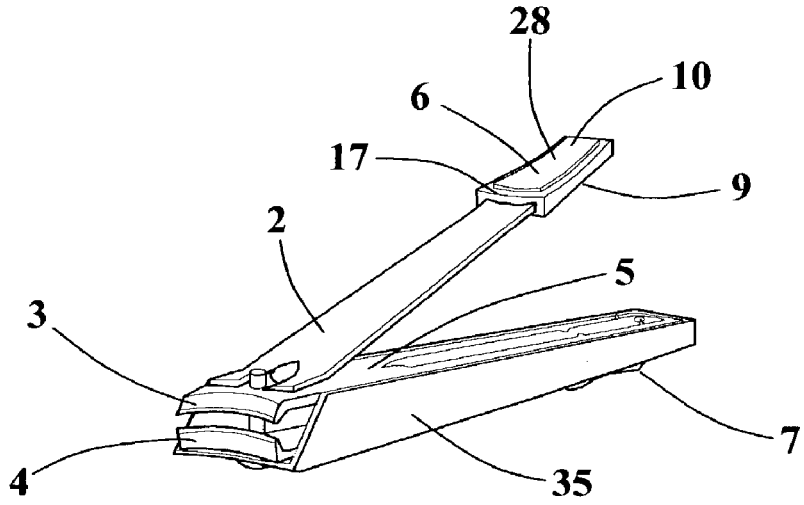
FIG. 2 is a perspective view of the nail clipper with the lever arm in a ready to use position.

Nail clippers 1 are basically constructed with a lever arm 2 to control the engagement of a top cutting member 3 with a bottom cutting member 4 and a base 5. FIG. 1 shows the use of the padded receiving device of this invention on a nail clipper in a close position while FIG. 2 shows the padded nail clipper in an open ready to use position. The description herein applies to both fingernail clippers and toenail clippers. The invention is specific to a padded receiving device 6 as used for example for the lever arm 2 and to a padded receiving device 7 as used for example with the base 5. Therefore, the other parts of the nail clipper will be described only as needed.

Figure 3:
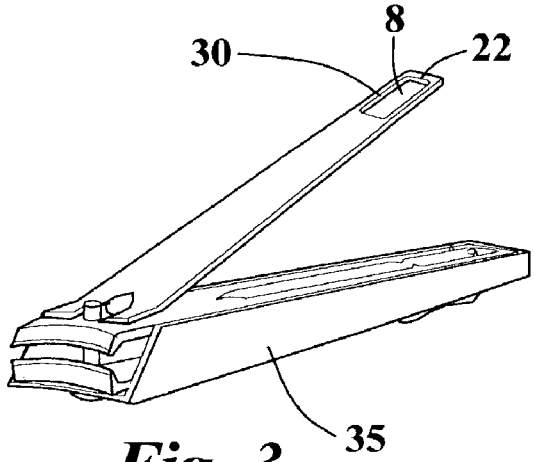
FIG. 3 shows the opening at the lever arm of the nail clipper.
Figure 4A:
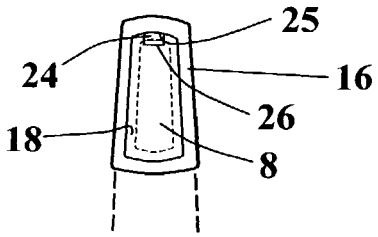
FIG. 4A is a front plan view of a pad holder slipped into the lever arm.
Figure 4A:
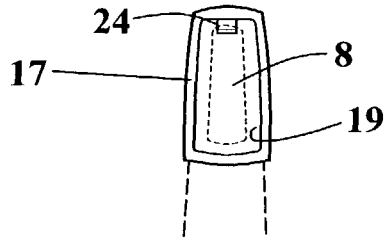
Figure 4B:
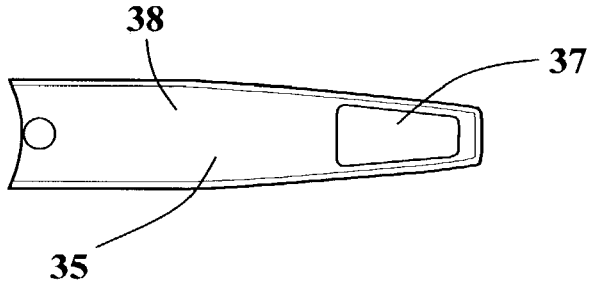
FIG. 4B is a back plan view of a base engaging case, for the base of the nail clipper.
Figure 4C:
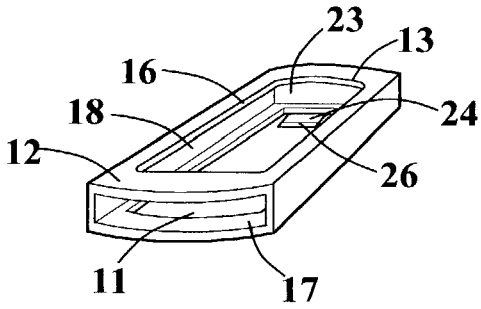
FIG. 4C shows a perspective view of the pad holder having a front slit with the rear end closed.
Figure 4D:
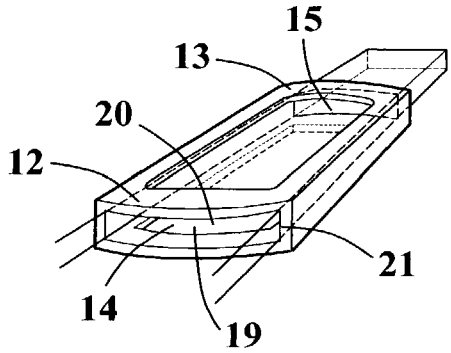
FIG. 4D shows a perspective view of an alternate pad holder having a front and a rear end slit.
Figure 4E:
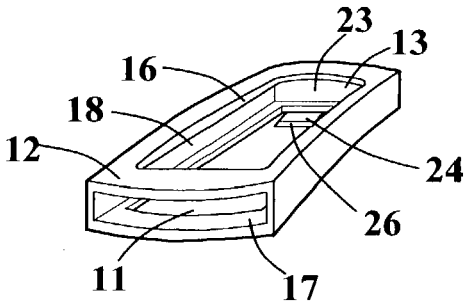
FIG. 4E is a perspective view of a pad holder having curved side walls.

The padded receiving device 6 on the lever arm 2 are installed by boring an opening 8 on the lever arm as shown in FIG. 3. The shape of this opening may vary and is at the discretion of the manufacturer. The shape of the opening 8 usually but not always dictate the shape of the padded receiving device 6. The padded receiving device 6 may be a combination of a pad holder 9 and a pad 10 or a pad 10 by itself. The pad holder 9 as shown in FIGS. 2, 4A and 4B is slipped from the distal end of the lever arm 2. The distal end is the end opposite the cutting members. In the type of pad holder shown in FIG. 4C, there is a slit 11 at the front end 12 while the rear end 13 is closed, not allowing the distal end of the lever arm 2 to go through. In the alternate design of the pad holder 9 as shown in FIG. 4D, there are slits on both the front 12 and the rear end 13. These pad holders are more suitable for use on other nail care devices such as emery boards and nail files where the pad holder can be made to slip into and through the specific nail care device and made to lodge at positions where the fingers hold the respective devices. In this application, to position the pad holder, the front slit 14 should match the width and height or thickness of the nail care device where the pad holder should stop advancing while the rear slit 15 matches the width and height or thickness of the nail care device at the location of the rear slit. The pad holder 9 may be molded in one piece or attached together from two pieces, with a top member 16 fused or glued to a bottom member 17. There is an opening 18, referred to as first opening on the top member 16 and another opening 19, referred to as second opening on the bottom member 17 as shown in FIGS. 4C and 4D. For proper orientation, the designation of top and bottom follows their position when the lever arm 2 of the nail clipper 1 is in a close position. Consequently, the bottom member 17 switches to the top when the lever arm is switched to an open ready to use position. In this position, the bottom member would be the one directly engaging with the finger when the nail clipper is in use. As shown in FIG. 4A, the first opening 18 on the top member 16 is slightly bigger than the opening 8 on the lever arm. The second opening 19 on the bottom member 17 may be made even bigger than the opening 18 if a wider padded area is desired since this member as stated above, switches to the top when the nail clipper is in use. Both openings 18 and 19 preferably have the same shape and contour as the shape of opening 8 on the lever arm. The width 20 and height 21 of the front slit 14 is just enough to allow the lever arm to slip in. The lever arm 2 of the nail clipper is advanced into the pad holder 9 until the distal edge 22 of the lever arm touches the interior surface 23 of the rear end 13. The width and height of the front slit and the width and height of the interior surface of the rear end of the pad holder correspond to the respective widths and height or thickness of the lever arm to snugly fit the pad holder 9 at the distal end of the lever arm 2. A hook 24 as shown in FIGS. 4A, 4A', 4C and 4E, protrude laterally inward towards the second opening 19 from the rear end of the bottom member 17. The hook 24 faces upwards and attaches at the rear side 25 of the opening 8 of the lever arm as shown in FIG. 4A to keep the pad holder in place. After the pad holder fully engages with the lever arm, the head 26 of the hook 24 extends beyond the rear side 25 of the opening 8. This protruding head 26 is used to engage the pad holder 9 with the pad 10. The pad holder may be flat on both top and bottom face as shown in FIGS. 4C and 4D but it may also be curved as desired in either or both faces as shown in FIGS. 2 and 4E.

Figure 5:
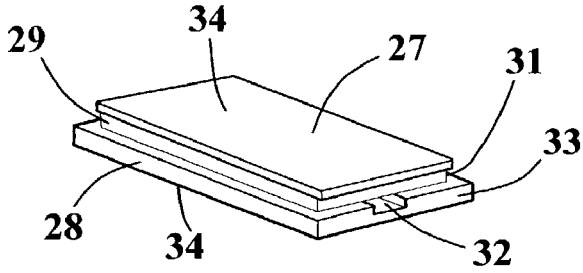
FIG. 5 is a perspective view of a pad usable for the pad holder shown in FIGS. 4A–E.
Figure 5A:
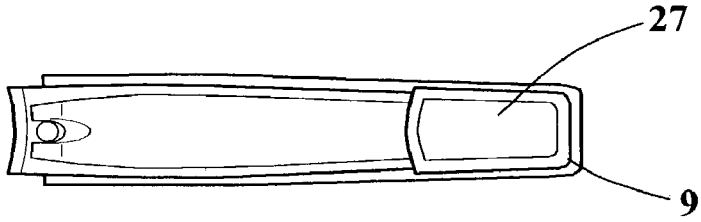
FIG. 5A is a front plan view of the nail clipper having a padded receiving device.
Figure 8A:
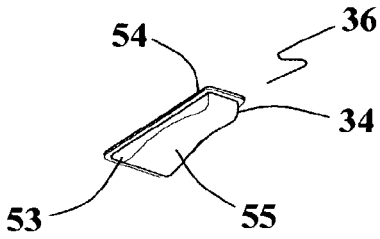
FIG. 8A is a perspective view of the pads usable for the base engaging case shown in FIG. 7 having an external concave surface.
Figure 8B:
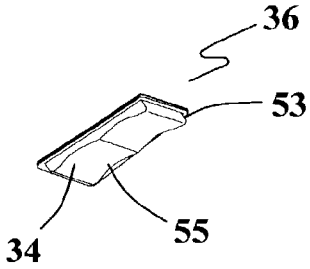
FIG. 8B is a perspective view of the pads usable for the base engaging case shown in FIG. 7 having an external adjacent concave surface.
Figure 8C:
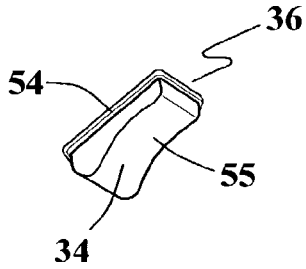
FIG. 8C is a perspective view of the pads usable for the base engaging case shown in FIG. 7 having an external sloping surface.

The pad 10 as shown in FIG. 5 is a single piece having a top piece 27 and a bottom piece 28 joined together by a center piece 29 matching the contour and covering the depth 30 of the opening 8 of the lever arm. The height 31 of the center piece 29 matches the height 21 of the front slit 14. The top piece 27 of the pad 10 matches the contour and covers the first opening 18 of the pad holder 9 as shown in FIG. 5A. The bottom piece 28 matches the contour and covers second opening 19 of the pad holder as shown in FIG. 2. The bottom piece of the pad has a cut 32 etched out on the rear end 33 to accommodate the protruding head 26 of the hook extending from the bottom member 17. To provide comfort for the user, the top piece 27 of the pad 10 may protrude from the top member 16 of the pad holder and is made of soft and resilient material such as gel, silicone, latex and other rubber like materials. The bottom piece 28, however, must protrude from the bottom member 17 because this is the piece exposed to the fingers when the nail clipper is in the use position. This is likewise made of the same material as the top piece. The center piece 29 may be made of the same material as the top and bottom pieces to facilitate the molding of the pad. This design protects the fingers from pressing on the hard surface of the pad holder and the nail clipper thereby preventing the formation of corn and callouses. The respective external surfaces 34 of the top and bottom pieces may be ergonomically carved to accommodate the fingers, for example, with one concave as shown in FIG. 8A, two adjacent concave carvings as shown in FIG. 8B or with one side sloping more than the other as shown in FIG. 8C. Carving is not necessary if the top and bottom pieces of the pad are made of gel because this will follow the shape of the fingers.

Figure 6:
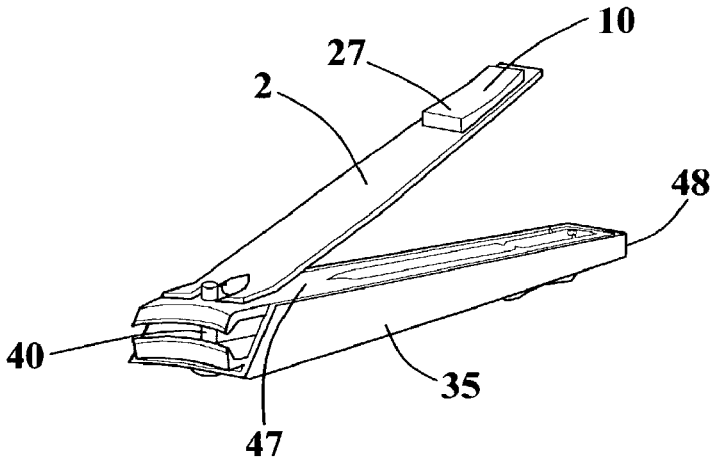
FIG. 6 is a perspective view of a nail clipper with a pad in the absence of a pad holder.

The main function of the pad holder is to support the pad. The pad holder may lengthen the usable life of the pad. However, the pad can be installed on the nail care device independent of the pad holder by directly introducing the pad into the opening 8 of the lever arm without the use of a pad holder as shown in FIG. 6. To install, the top piece 27 of the pad is merely squeezed through the opening 8 and allowed to rest on the top external surface of the lever arm with the center piece 29 residing at the opening 8 while the bottom piece 28 covers and rests on the external bottom surface of the lever arm. The surface area of the top piece may be different from the bottom piece and if no pad holder will be used with the pad, there is no need to etch out cut 32.

To install the pad 10 in a pad holder, the latter 9 should be fully inserted to the lever arm at a position shown in FIGS. 2 and 4A. The lever arm 2 is flipped over to an open ready to use position. The top piece 27 of the pad is squeezed through the opening 8 of the lever arm but prior to squeezing, the head 26 of the hook 24 is slipped into the etched out cut 32 on the bottom piece 28 of the pad. After the top piece 27 squeezes through and lodges itself and covers the first opening 18 of the top member 16 of the pad holder, the bottom piece 28 rests, covers and protrudes from the second opening 19 of the bottom member 17 while the centerpiece 29 of the pad resides at the opening 8. The above assembly and installation provide a padded area on both external surfaces of the top and bottom members of the pad holder 9. The padded area on the top member need not but preferably protrude from the external top surface of the lever arm because this side is not constantly pressed upon. The padded area on the bottom member, however, has to protrude from the external bottom surface of the lever arm because it is this side that is constantly pressed upon on usage to prevent the formation of corn and callouses and provide comfort to the user.

Figure 7:
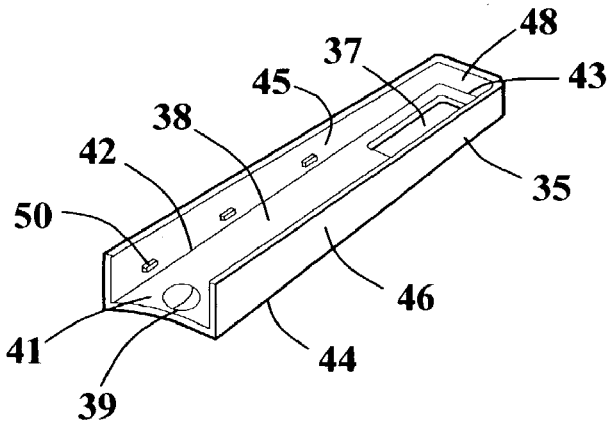
FIG. 7 is a perspective view of the base engaging case with the opening.
Figure 9:
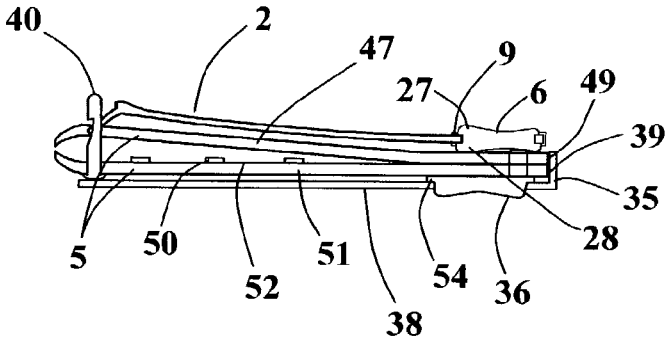
FIG. 9 is a cross sectional view of the nail clipper having a base engaging case with the pad inserted into the opening taken along A—A of FIG. 1.

To provide a padded area on the base 5 of the nail clipper 1, a padded base engaging case 35, an example of the padded receiving device 7 shown in detail on FIGS. 7 and 9 is used to hold the pad 36. As in the lever arm of the nail clipper, an opening 37 is bored on the base engaging case 35 at a location where the padded area is desired. The base engaging case is constructed to snugly enclose the base 5 leaving open, however, the sides needed for the unobstructed operation of the functioning parts of the nail care device such as the side where the top and bottom cutting members 3 and 4 and the lever arm 2 are located. Snugly means once the base 5 is engaged with the base engaging case 35, the base engaging case does not fall off from the base and the external sides of the base touch the corresponding internal surfaces of the base engaging case 35, hereinafter also simply referred to as case. Generally, the shape of the base engaging case conforms with the shape of the base of the nail care device in order to snugly enclose the base. The case for the nail clipper has three side walls and a bottom face. The bottom face 38 is shaped according to the shape of the base 5 of the nail clipper 1 as shown in FIG. 4B. Aside from the opening 37 on the case, the internal surface 39 of the case may have indentations to accommodate protruding parts on the base 5 such as the base of the connector 40 which holds the top and bottom cutting members. One side 41, which in this example is the front side of the case, is open. This is usually the side through which the base is introduced into the case. The three sides, two lateral sides and a rear side have walls extending upwards from their peripheral edges 42, 43, and 44 to form a continuous upstanding wall. The walls are not of the same height. The height of the lateral walls 45 and 46 varies according to the shape of the top plate 47 extending from the top cutting member 3 as shown in FIGS. 1, 2 and 6. The height of the rear wall 48 is just enough to cover the corresponding rear side 49 of the base. The interior of the lateral walls 45 and 46 incorporates at least one inwardly extending flange 50 on each side of the wall directly opposite each other. If there are more than one flange on each wall, the plurality of flanges 50 are in a juxtaposed, spaced and cooperating relationship. These flanges are preferably positioned above or on top of the base or a desired component of the base, which in the case of nail clippers, rest on top of the surface 52 of the bottom plate 51 extending from the bottom cutting member 4 when the base is fully engaged with the case as shown in FIG. 9. The flanges 50 aid in keeping the base 5 of the nail clipper engaged with the case 35. When the base is fully inserted in the case, only the top and bottom cutting members, the connector and the lever arm are exposed as shown in FIGS. 1, 2, 3 and 6.

The opening 37 on the case 35 can be of any desired shape. A base engaging case pad 36 inserts, covers and protrudes from the opening. Consequently, the shape of the pad conforms to the contour of the opening 37. The thickness 53 of the base engaging case pad 36 is greater than the thickness of the case to allow the pad to protrude beyond the external surface of the bottom face 38 of the case 35. As shown in FIGS. 8A, 8B and 8C, the base engaging case pad 36 has a lip 54 extending laterally from the bottom of the pad to serve as a stopper when the pad 36 is inserted into the opening 37 thereby preventing the pad from falling off. The lip preferably .surrounds the bottom of the pad and extends laterally beyond the opening 37. The lip is very thin so as not to interfere or block the entry of the base 5 into the case 35. The external surfaces 34 may also be carved ergonomically in the same manner as the external surfaces of the top and bottom piece of the pad 10.

To install the padded receiving device 7 for the base into the nail clipper, the pad 36 is first inserted into the opening 37 with the top surface 55 inserting through the opening until the lip 54 engages with the internal surface of the bottom face 38 of the case. At this point, the base 5 of the nail clipper is inserted into the open side 41 of the case 35 with the rear side of the base 49 introduced first until this engages with the rear internal surface 39 of the case 35. During the insertion, the flanges 50 should be positioned on top of the bottom plate 51 as described above. Because the base is introduced into the case through the open side 41, the material from which the case is made must be resilient to tolerate the variable width of the base 5 as it inserts into the case. Examples of suitable plastic materials for the case are made from acrylonitrile butadiene styrene resin; styrene-acrylonitrile resin; cellulose acetate butyrate; polycarbonate; polyethylene; polypropylene; polystyrene; and, polyvinylchloride acetate.

Figure 10:
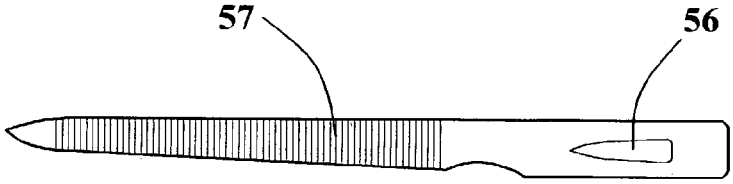
Fig. 10 PRIOR ART
FIG. 10 is a plan view of a nail file.
Figure 10A:
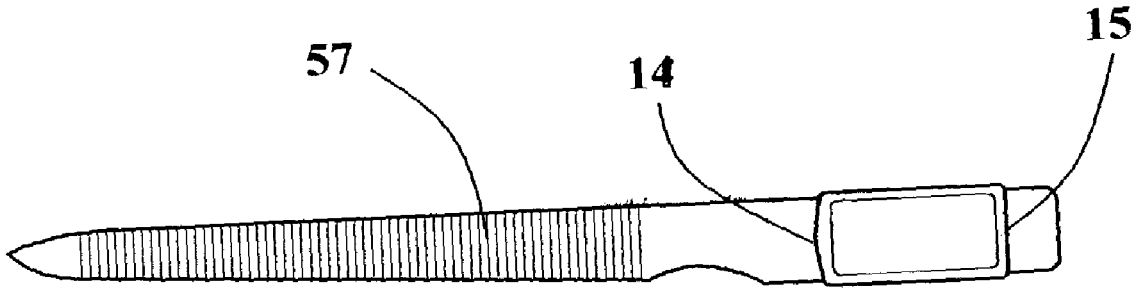
FIG. 10A is a plan view of the nail file having a pad on a pad holder.
Figure 10B:
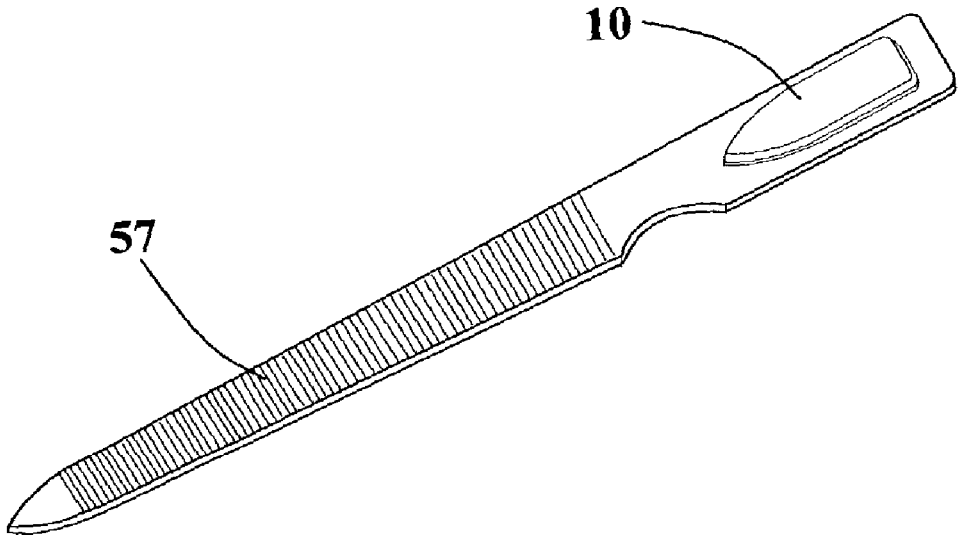
FIG. 10B is a perspective view of the nail file having a pad without a pad holder.

The padded receiving device of this invention is shown herein installed on nail clippers. However, the padded receiving device may be applied to other nail care devices such as the nail files currently available in the market. Some nail files already have an opening 56 as shown in FIG. 10. It is very easy to put a pad with a pad holder on this opening as shown in FIG. 10A or without a pad holder as shown in FIG. 10B in the same manner described for the lever arm above. If a pad holder 9 is used for this, it should use the pad holder shown in FIG. 4D because the body 57 of the nail file needs to enter the front slit 14 and exit the rear slit 15 of the pad holder. The slits 14 and 15 should just be enough to accommodate the width and the height or thickness of the nail file at the corresponding locations so as to snugly fit into the nail file.

While the embodiment of the present invention has been described, it should be understood that various changes, modifications and adaptations may be made therein without departing from the spirit of the invention and the scope of the appended claims. Those skilled in the art will recognize that other and further variations of the features presented herein are possible. The scope of the present invention should be determined by the teachings disclosed herein, the appended claims and their legal equivalents.

I claim:

1. A padded receiving device for nail care devices, comprising:

a pad having a top piece and a bottom piece joined together by a center piece, the center piece matching and covering an opening on the nail care device through which the pad is introduced into, the top piece and the bottom piece each having a size larger than the center piece covering an external surface of the nail care device; and, a pad holder for supporting the pad, the pad holder having a front slit wherein the nail care device is slipped through, the front slit having a width and height matching a width and height of the nail care device at a location of the front slit, a top member having a first opening and a bottom member having a second opening, the top and bottom member molded in one piece or attached together, a hook with a head protruding laterally inward from a rear end of the bottom member towards the second opening wherein the top piece of the pad has a size matching and covering the first opening and the bottom piece of the pad matching and covering the second opening, the bottom piece having a cut etched out on a rear end to accommodate the head of the hook extending from the bottom member of the pad holder.

2. The padded receiving device of claim 1 wherein the nail care device is a nail cutter.

3. The padded receiving device of claim 1 wherein the pad is made of soft and resilient material.

4. The padded receiving device of claim 1 wherein the pad is made of gel, silicone, latex or other rubber like materials.

5. The padded receiving device of claim 1 wherein the bottom piece of the pad protrudes from the bottom member of the pad holder.

6. The padded receiving device of claim 1 wherein the top piece of the pad protrudes from the top member and the bottom piece of the pad protrudes from the bottom member of the pad holder.

7. The padded receiving device of claim 1 wherein the opening on the nail care device can have different shapes.

8. The padded receiving device of claim 1 wherein a rear end of the pad holder is closed.

9. The padded receiving device of claim 1 wherein a rear end of the pad holder has a rear slit, the rear slit having a width and height matching the width and height of the nail care device at a location of the rear slit.

10. The padded receiving device of claim 1 wherein the size of the first opening is different from the size of the second opening with both openings bigger than the opening on the nail care device.

11. The padded receiving device of claim 1 wherein the pad holder has a top and bottom face, both top and bottom face flat or curved, or one face curved and one face flat.

12. The padded receiving device of claim 1 wherein the top and bottom pieces of the pad or either one of the top and bottom piece has an external surface carved to ergonomically accommodate a finger.

13. The padded receiving device of claim 1 further comprising a padded base engaging case for nail care devices having a base, the base engaging case having an opening bored for accommodating a base engaging case pad protruding from the opening of the base engaging case, three side walls and a bottom face of the base engaging case snugly enclosing the base of the nail care device, leaving open sides of the base engaging case for functioning parts of the nail care device needed for operation, the base engaging case pad having a top end and a bottom end, the bottom end having a lip extending laterally from the bottom end to prevent the pad from falling off the opening of the base engaging case, and, means for keeping the base of the nail care device engaged with the base engaging case.

14. The padded receiving device of claim 13 wherein the means for keeping the base engaged with the base o engaging case is an inwardly extending flange positioned on top of the base or a component of the base.

15. The padded receiving device of claim 13 wherein the base engaging case is made of a resilient material.

16. The padded receiving device of claim 15 wherein the resilient material is a plastic material made from acrylonitrile butadiene styrene resin; styrene-acrylonitrile resin; cellulose acetate butyrate; polycarbonate; polyethylene; polypropylene; polystyrene; and, polyvinylchloride acetate.

17. A nail clipper having a padded receiving device on its lever arm and base, the padded receiving device for the lever arm comprising a pad holder for supporting a soft and resilient pad, the pad holder having a front slit wherein the lever arm is slipped through, the front slit having a width and height matching a width and height of the lever arm at a location of the front slit, a top member having a first opening and a bottom member having a second opening, the top and bottom member molded in one piece or attached together, a hook with a head protruding laterally inward from a rear end of the bottom member towards the second opening, the pad having a top piece and a bottom piece joined together by a center piece, the center piece having a contour and size matching and covering an opening on the nail clipper through which the pad is introduced into and having a height matching the height of the front slit, the top piece having a size matching and covering the first opening of the top member of the pad holder, the bottom piece having a size matching and covering the second opening of the bottom member of the pad holder, the bottom piece having a cut etched out on a rear end to accommodate the head of the hook extending from the bottom member of the pad holder; and, a padded base engaging case installed at its base, the padded base engaging case having a base engaging case with an opening bored for accommodating a base engaging case pad protruding from the opening of the base engaging case, the base engaging case having three side walls and a bottom face snugly enclosing the base of the nail clipper, leaving open sides of the base engaging case for a functional top and bottom cutting members and the lever arm of the nail cutter needed for operation, the base engaging case pad having a top end and a bottom end, the bottom end having a lip extending laterally from the bottom end to prevent the pad from falling off the opening of the base engaging case and the case having inwardly extending flange positioned on top of a surface of the base or a component of the base to keep the base engaged with the base engaging case.

18. A nail clipper having a padded receiving device on its lever arm and base, the padded receiving device for the lever arm comprising a soft and resilient pad having a top piece and a bottom piece joined together by a center piece, the center piece having a contour and size matching and covering an opening on the lever arm of the nail clipper through which the pad is introduced into, the top piece and the bottom piece having a size larger than the opening of the lever arm; and, a padded base engaging case installed on its base, the padded base engaging case having a base engaging case with an opening bored for accommodating a base engaging case pad protruding from the opening of the base engaging case, the base engaging case having three side walls and a bottom face snugly enclosing the base of the nail clipper, leaving open sides of the base engaging case for a functional top and bottom cutting members and the lever arm of the nail cutter needed for operation, the base engaging case pad having a top end and a bottom end, the bottom end having a lip extending laterally from the bottom end to prevent the pad from falling off the opening of the base engaging case and the case having inwardly extending flange positioned on top of a surface of the base or a component of the base of the nail clipper to keep the base engaged with the base engaging case.

19. A padded receiving device for nail care devices, comprising:

a pad having a top piece and a bottom piece joined together by a center piece, the center piece having a contour and size matching and covering an opening on the nail care device through which the pad is introduced into, the top piece and the bottom piece each having a size larger than the center piece covering an external surface of the nail care device; and, a pad holder for supporting the pad, the pad holder having a front slit wherein the nail care device is slipped through, the front slit having a width and height matching a width and, height of the nail care device at a location of the front slit, a top member having a first opening and a bottom member having a second opening, the top and bottom member molded in one piece or attached together, and a hook with a head protruding laterally inward from a rear end of the bottom member towards the second opening.

20. The padded receiving device of claim 19 wherein the top piece of the pad has a size matching and covering the first opening of the pad holder and the bottom piece of the pad matching and covering the second opening of the pad holder, the bottom piece having a cut etched out on a rear end to accommodate the head of the hook extending from the bottom member of the pad holder.

* * * * *